US010677190B2

(12) United States Patent
Vaseleniuck et al.

(10) Patent No.: US 10,677,190 B2
(45) Date of Patent: Jun. 9, 2020

(54) ENGINE WITH ROTATING VALVE ASSEMBLY

(71) Applicant: Vaztec Engine Venture, LLC, Mooresville, NC (US)

(72) Inventors: Darrick Vaseleniuck, Mooresville, NC (US); David Vaseleniuck, Mooresville, NC (US)

(73) Assignee: VAZTEC ENGINE VENTURE, LLC, Mooresville, NC (US)

( * ) Notice: Subject to any disclaimer, the term of this patent is extended or adjusted under 35 U.S.C. 154(b) by 0 days.

(21) Appl. No.: 16/117,704

(22) Filed: Aug. 30, 2018

(65) Prior Publication Data

US 2019/0078532 A1 Mar. 14, 2019

Related U.S. Application Data

(60) Provisional application No. 62/557,800, filed on Sep. 13, 2017.

(51) Int. Cl.

| | |
|---|---|
| ***F02F 1/42*** | (2006.01) |
| ***F01L 7/16*** | (2006.01) |
| ***F01L 7/02*** | (2006.01) |
| *F02F 1/24* | (2006.01) |
| *F01L 1/053* | (2006.01) |
| *F01L 1/34* | (2006.01) |

(Continued)

(52) U.S. Cl.

CPC ..... *F02F 1/4285* (2013.01); *F01L 7/023* (2013.01); *F01L 7/026* (2013.01); *F01L 7/027* (2013.01); *F01L 7/16* (2013.01); *F01L 1/34* (2013.01); *F01L 7/14* (2013.01); *F01L 7/18* (2013.01); *F01L 2001/0537* (2013.01); *F01L 2250/04* (2013.01); *F02F 2001/244* (2013.01); *F02F 2001/4207* (2013.01)

(58) Field of Classification Search

CPC ..... F02F 1/4285; F02F 2001/244; F02F 2001/4207; F01L 7/023; F01L 7/026; F01L 7/14; F01L 7/18; F01L 7/16; F01L 7/00; F01L 7/027

See application file for complete search history.

(56) References Cited

U.S. PATENT DOCUMENTS 3,896,781 A * 7/1975 Smith ..... F01L 7/026 123/190.8

2002/0139342 A1* 10/2002 Trentham ..... F01L 7/026 123/190.8

(Continued)

*Primary Examiner* — Jacob M Amick

(74) *Attorney, Agent, or Firm* — Trego, Hines & Ladenheim, PLLC; Brandon Trego; Jonathan Hines

(57) ABSTRACT

An engine with a rotating valve assembly is disclosed. The valve assembly including a housing having an internal cavity, an open top, and an open bottom, the open top and open bottom being in fluid communication with the internal cavity; a valve barrel positioned in the internal cavity and adapted for rotation therein, the valve barrel having an annular peripheral surface and an aperture extending transversely therethrough communicating with the peripheral surface on opposite sides; a first seal assembly positioned in the open top and a second seal assembly positioned in the open bottom, the first and second seal assemblies each include a seal having a sealing surface in mating engagement with the peripheral surface and an aperture extending therethrough.

20 Claims, 10 Drawing Sheets

(51) Int. Cl.
*F01L 7/14* (2006.01)
*F01L 7/18* (2006.01)

(56) References Cited

U.S. PATENT DOCUMENTS

2006/0185640 A1* 8/2006 Barnes ..... F01L 7/022
123/190.8
2016/0222839 A1* 8/2016 Vaseleniuck ..... F01L 7/16

* cited by examiner

ENGINE WITH ROTATING VALVE ASSEMBLY

BACKGROUND OF THE INVENTION

This invention relates generally to internal combustion engines, and more particularly to engines using rotary valves.

Internal combustion engines are well known and are used in various applications. For example, internal combustion engines are used in automobiles, farm equipment, lawn mowers, and watercraft. Internal combustion engines also come in various sizes and configurations, such as two stroke or four stroke and ignition or compression.

Typically, internal combustion engines (FIG. 1) include a multitude of moving parts, for example, they include intake and exhaust valves, rocker arms, springs, camshafts, connecting rods, pistons, and a crankshaft. One of the problems with having a multitude of moving parts is that the risk of failure increases (particularly in the valve train) and efficiency decreases due to frictional losses. Special lubricants and coatings may be used to reduce friction and certain alloys may be used to prevent failure; however, even with these enhancements, the risk of failure and the frictional losses remain high. Additionally, when valve trains fail, repairing the broken valve train can be time intensive and require special tools, thereby making it very difficult to repair in the field.

Accordingly, there remains a need for a valve train for an internal combustion engine with low friction, good reliability, a small number of parts, and capable of being replaced and/or repaired in the field quickly and easily.

BRIEF SUMMARY OF THE INVENTION

This need is addressed by the present invention, which provides a valve train made up of individual rotating valve assemblies that may be removed one at a time and replaced with new rotating valve assemblies quickly and easily.

According to one aspect of the technology, a valve assembly includes a housing having an internal cavity, an open top, and an open bottom, the open top and open bottom being in fluid communication with the internal cavity; a valve barrel positioned in the internal cavity and adapted for rotation therein, the valve barrel having an annular peripheral surface and an aperture extending transversely therethrough communicating with the peripheral surface on opposite sides; a first seal assembly positioned in the open top and a second seal assembly positioned in the open bottom, wherein the first and second seal assemblies each include a seal having a sealing surface in mating engagement with the peripheral surface and an aperture extending therethrough, the aperture having a size and shape substantially equal to the aperture in the valve barrel to permit flow therethrough; and wherein when the aperture of the valve barrel is in alignment with the apertures of the first and second seal assemblies, gas is permitted to flow through the valve assembly.

According to another aspect of the technology, a cylinder head assembly includes at least one intake valve assembly pocket defined by upper and lower cylinder head sections and at least one exhaust intake valve assembly pocket defined by the upper and lower cylinder head sections; at least one intake valve assembly positioned in the at least one intake valve assembly pocket and at least one exhaust valve assembly positioned in the at least one exhaust valve assembly pocket, the at least one intake valve assembly and at least one exhaust valve assembly each includes: a housing having an internal cavity, an open top, and an open bottom, the open top and open bottom being in fluid communication with the internal cavity; a valve barrel positioned in the internal cavity and adapted for rotation therein, the valve barrel having an annular peripheral surface and an aperture extending transversely therethrough communicating with the peripheral surface on opposite sides; a first seal assembly positioned in the open top and a second seal assembly positioned in the open bottom, wherein the first and second seal assemblies each include a seal having a sealing surface in mating engagement with the peripheral surface and an aperture extending therethrough, the aperture having a size and shape substantially equal to the aperture in the valve barrel to permit flow therethrough; and wherein when the aperture of the valve barrel is in alignment with the apertures of the first and second seal assemblies, gas is permitted to flow through the valve assembly.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
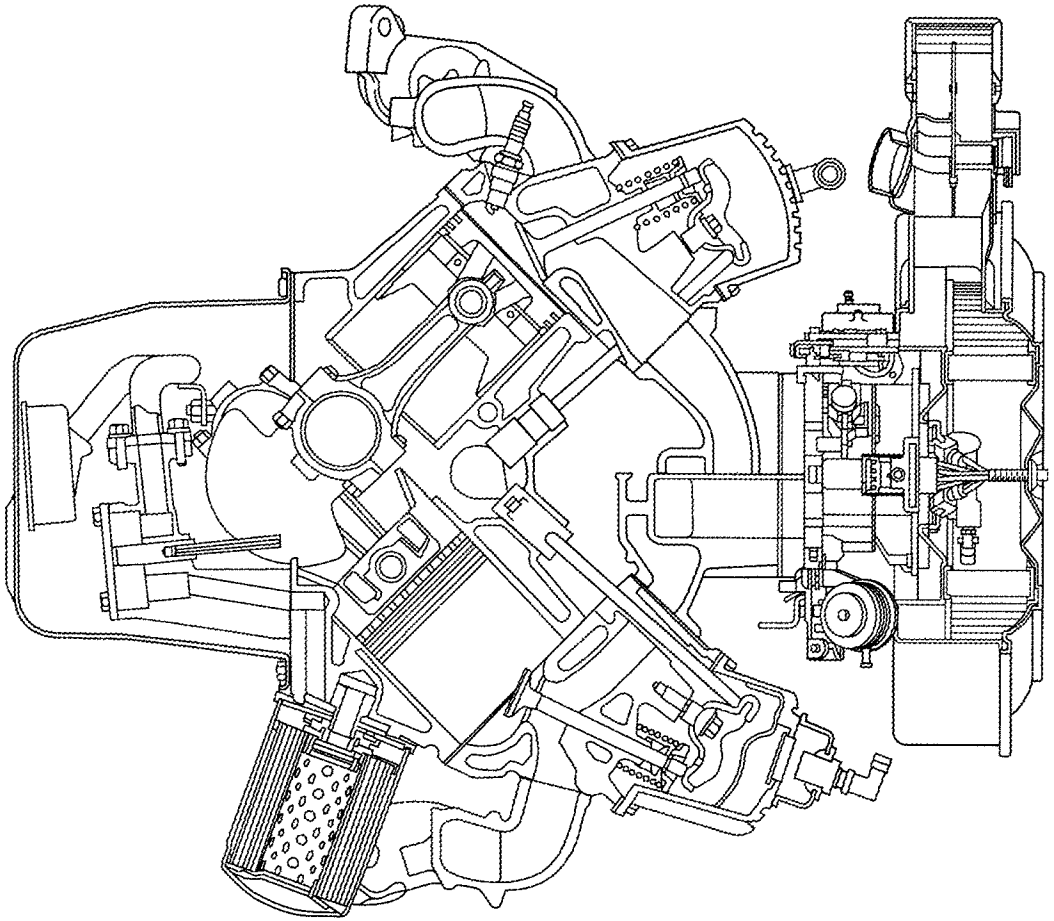
FIG. 1 (Prior Art)
FIG. 1 is a schematic cross-sectional view of a prior art internal combustion engine.
Figure 2:
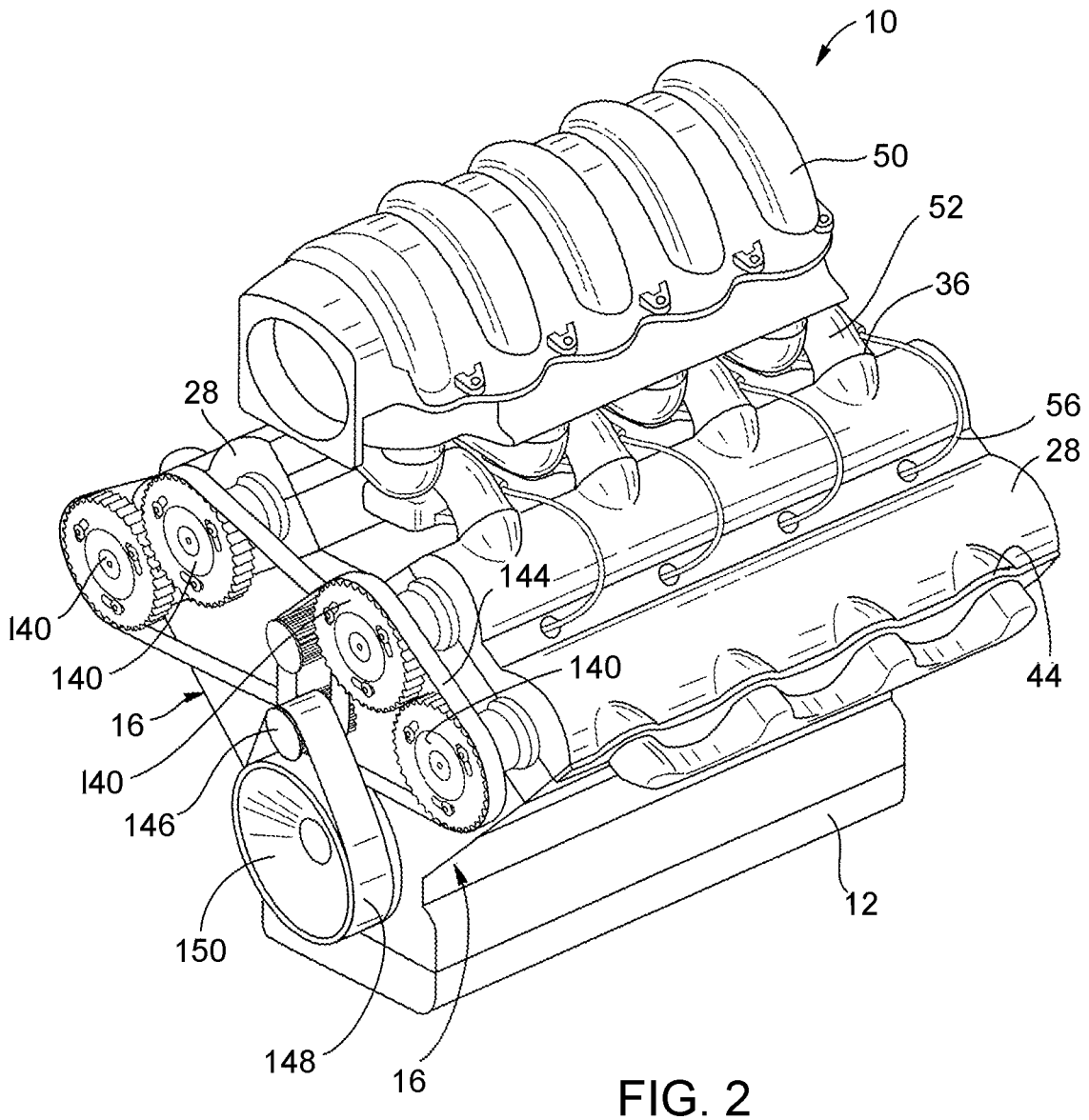
FIG. 2 is a schematic perspective of an internal combustion engine constructed in accordance with an aspect of the present invention.
Figure 3:
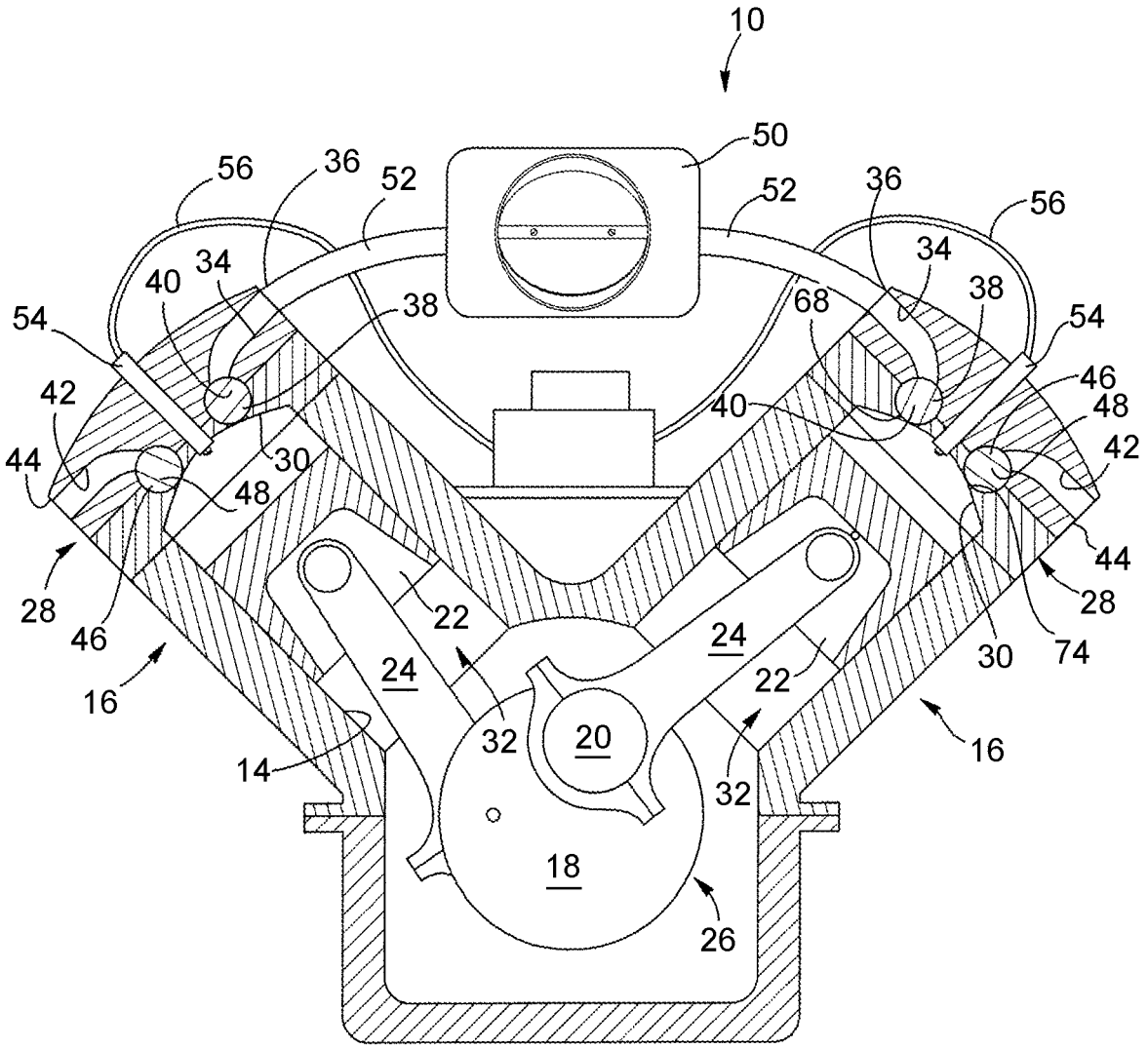
FIG. 3 is a cross-sectional view of the internal combustion engine of FIG. 1.

Referring to the drawings wherein identical reference numerals denote the same elements throughout the various views, FIGS. 2 and 3 illustrate an exemplary internal combustion engine 10 constructed according to an aspect of the present invention.

The illustrated example is an eight-cylinder engine 10 of vee configuration, commonly referred to as a "V-8", with two banks of four cylinders set 90 degrees to each other. However, it will be understood that the principles of the present invention are applicable to any internal combustion engine, for example engines running various cycles such as Otto or Diesel cycles, or similar machines requiring valves to open and close fluid flow ports.

The engine includes a block 12 which serves as a structural support and mounting point for the other components of the engine 10. Generally cylindrical cylinder bores 14 are formed within the block 12. As noted above, the cylinder bores 14 are arranged in two longitudinal cylinder banks 16 of four cylinder bores 14 each. A crankshaft 18 having offset crankpins 20 is mounted in the block 12 for rotation in suitable bearings. A piston 22 is disposed in each cylinder bore 14, and each piston 22 is connected to one of the crankpins 20 by a piston rod 24. The crankshaft 18, piston rods 24, and pistons 22 collectively define a rotating assembly 26. In operation, gas pressure in the cylinder bores 14 causes linear movement of the pistons 22, and the rotating assembly 26 is operable in a known manner to convert linear movement of the pistons to rotation of the crankshaft.

The engine includes one cylinder head assembly 28 attached to each cylinder bank 16. The cylinder head assembly 28 has a generally concave combustion chamber 30 formed therein corresponding to and aligned with each cylinder bore 14. Collectively, each cylinder bore 14 and the corresponding combustion chamber 30 defines a cylinder 32.

Figure 4:
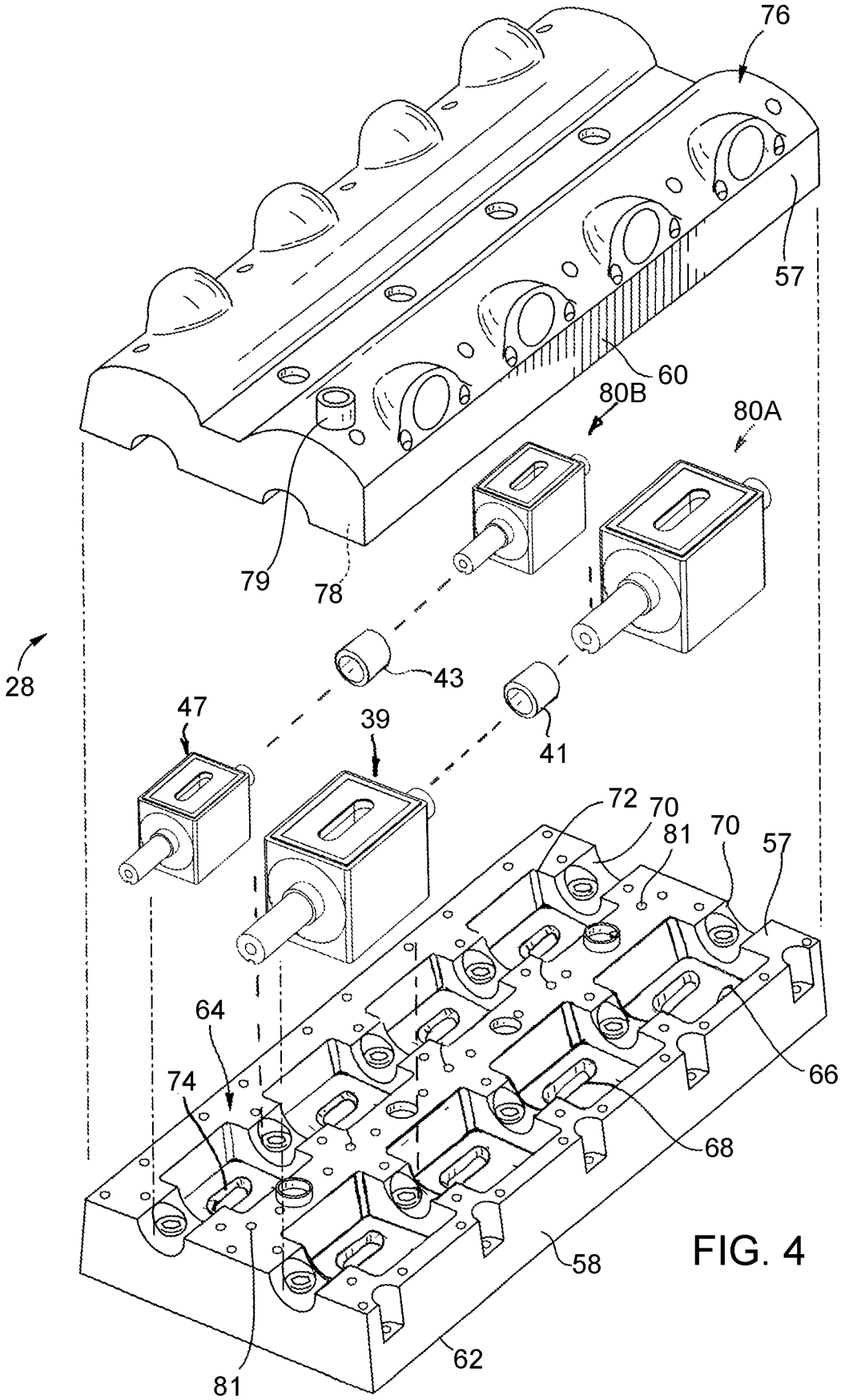
FIG. 4 is an exploded perspective view of a cylinder head assembly of the engine shown in FIG. 2.
Figure 6:
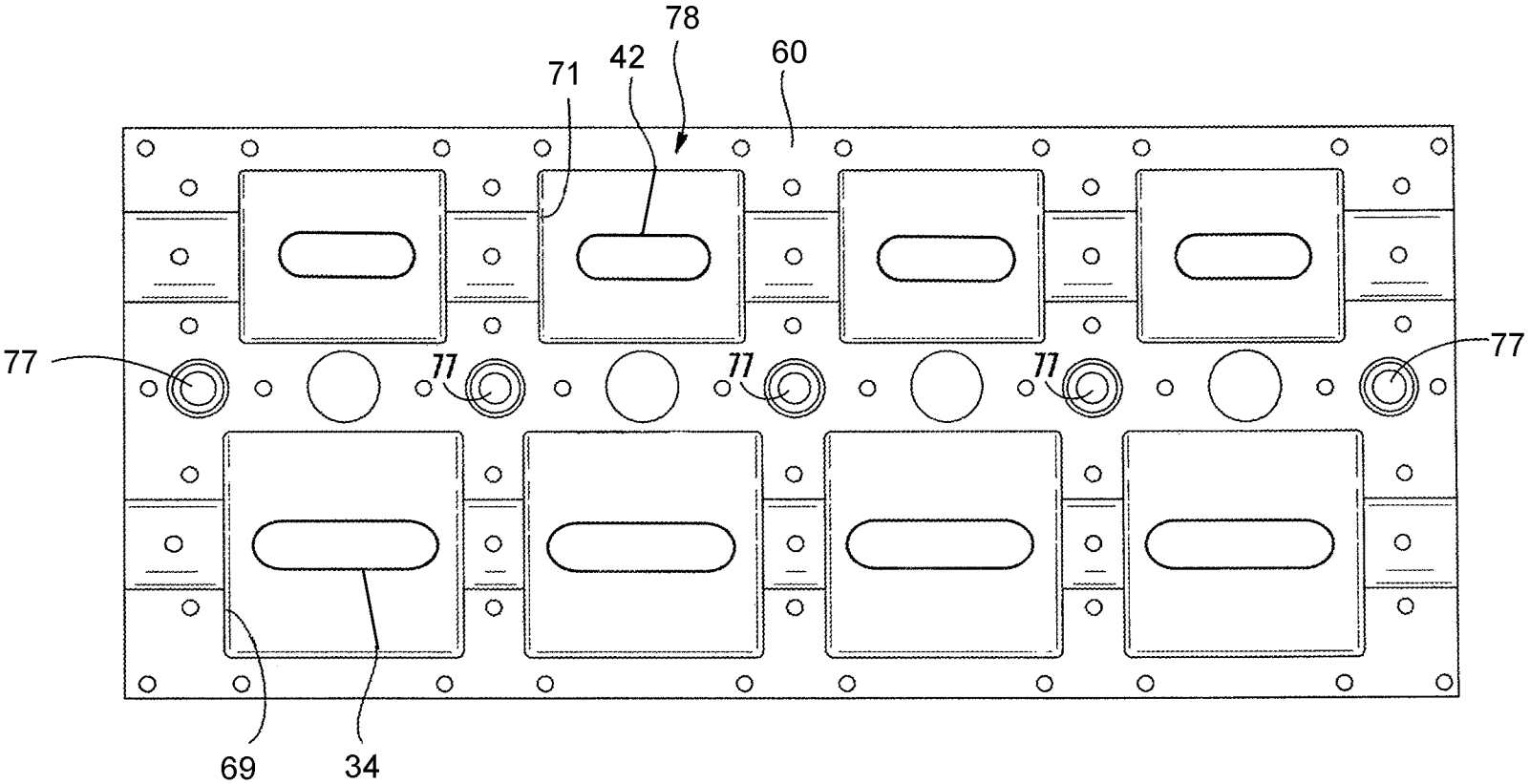
FIG. 6 is a bottom plan view of an upper section of the cylinder head assembly of FIG. 4.

The cylinder head assembly 28 has a plurality of intake ports 34 formed therein; each intake port 34 extends from one of the combustion chambers 30 to an intake plane 36 at an exterior surface of the cylinder head assembly 28. As will be described in detail below, an intake valve barrel 38 of a rotating valve assembly 39, FIGS. 4 and 6, is disposed across each intake port 34 and includes an intake aperture 40 passing therethrough. The intake port 34, intake valve barrel 38, and intake aperture 40 are arranged such that in a first angular orientation of the intake valve barrel 38, fluid flow is permitted between the intake plane 36 and the combustion chamber 30, and at a second angular orientation of the intake valve barrel 38, fluid flow is blocked between the intake plane 36 and the combustion chamber 30.

The cylinder head assembly 28 also includes a plurality of exhaust ports 42 formed therein; each exhaust port 42 extends from one of the combustion chambers 30 to an exhaust plane 44 at an exterior surface of the cylinder head assembly 28. As will be described in detail below, an exhaust valve barrel 46 of a rotating valve assembly 47, FIG. 4, is disposed across each exhaust port 42 and includes an exhaust aperture 48 passing therethrough. The exhaust port 42, exhaust valve barrel 46, and exhaust aperture 48 are arranged such that in a first angular orientation of the exhaust valve barrel 46, fluid flow is permitted between the exhaust plane 44 and the combustion chamber 30, and at a second angular orientation of the exhaust valve barrel 46, fluid flow is blocked between the exhaust plane 44 and the combustion chamber 30.

The engine 10 includes a fuel delivery system 50 which is operable to receive an incoming airflow, meter a hydrocarbon fuel such as gasoline into the airflow to generate a combustible intake mixture, and deliver the intake mixture to the cylinders 32.

The fuel delivery system 50 may be continuous flow or intermittent flow, and the fuel injection point may be at the individual cylinders 32 or at an upstream location. Optionally the fuel injection point may be within the cylinders 32, a configuration commonly referred to as "direct injection", in which case the intake ports 34 deliver only air to the cylinders 32. Known types of fuel delivery systems include carburetors, mechanical fuel injection systems, and electronic fuel injection systems. The specific example illustrated is an electronic fuel injection system with one intake runner 52 connected to each intake port 34.

The engine 10 includes an ignition system comprising one or more spark plugs 54 mounted in each combustion chamber 30, to ignite the intake mixture. An appropriate ignition power source is provided, such as a conventional Kettering ignition system with a coil and distributor, or a direct ignition system with a trigger module and multiple coils. The ignition power source is connected to the spark plugs 54, for example with leads 56.

FIG. 4 is an exploded view of one of the cylinder head assemblies 28. The cylinder head assembly 28 includes one or more stationary components that are configured to be mounted to the cylinder bank 16 and to enclose the operating parts. The cylinder head assembly 28 includes a cylinder head 57. In the illustrated example, the cylinder head 57 is made up of a lower section 58 attached to an upper section 60 with bolts. Alternatively, the cylinder head 57 could be made from a single block.

Figure 5:
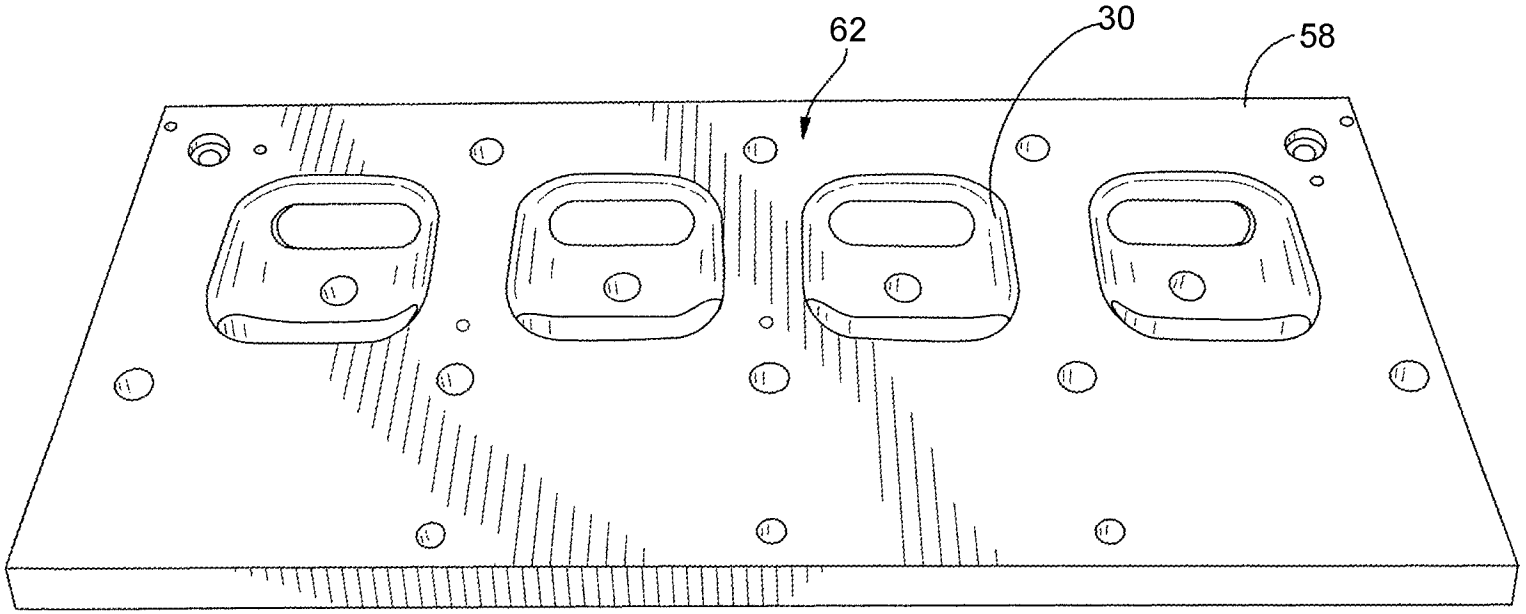
FIG. 5 is a bottom plan view of a lower section of the cylinder head assembly of FIG. 4.

The lower section 58 is a block-like element which may be formed by casting or machining from billet. It includes an exterior surface 62 which incorporates the combustion chambers 30 (see FIG. 5), and an opposed interior surface 64. Adjacent the interior surface 64, the lower section 58 has a plurality of intake valve assembly recesses 66 formed therein, arranged in a longitudinal line. Each intake valve assembly recess 66 communicates with an intake opening 68. A plurality of semi-cylindrical bearing recesses 70 alternate with the intake valve assembly recesses. The lower section 58 also has a plurality of exhaust valve assembly recesses 72 formed therein, arranged in a longitudinal line. Each exhaust valve assembly recess 72 communicates with an exhaust opening 74 (see FIG. 3). A plurality of semi-cylindrical bearing recesses 70 alternate with the exhaust valve assembly recesses 72.

The upper section 60 is also a block-like element which may be formed by casting or machining from billet. It includes an exterior surface 76, and an opposed interior surface 78 which mates with the interior surface 64 of the lower section 58. The intake ports 34 described above are formed as part of the upper section 60. Adjacent the interior surface 78, the upper section 60 has a plurality of intake valve assembly recesses 69 formed therein, arranged in a longitudinal line (see FIG. 6). Each intake valve assembly recess 69 communicates with one of the intake ports 34. A plurality of semi-cylindrical bearing recesses 70 alternate with the intake valve assembly recesses 69. The lower section 58 also has a plurality of exhaust valve assembly recesses 71 formed therein, arranged in a longitudinal line. Each exhaust valve assembly recess 71 communicates with one of the exhaust ports 42. A plurality of semi-cylindrical bearing recesses 70 alternate with the exhaust valve assembly recesses 71. The intake valve assembly recesses 66 and 69 collectively define an intake valve assembly pocket and the exhaust valve assembly recesses 71 and 72 define an exhaust valve assembly pocket when the lower 58 and upper 60 sections are mated together.

Provisions may be incorporated for liquid cooling all or part of the cylinder head 57. In the illustrated example, the upper section 60 includes a hollow interior chamber (not shown) disposed between the interior surface 78 and the exterior surface 76. A series of coolant inlet holes 77 (FIG. 6) are formed in the interior surface 78 and communicate with the interior chamber. A coolant outlet 79 (see FIG. 4) is formed in the exterior surface 76. In operation, a suitable liquid coolant, such as water or water mixed with an antifreeze agent, is supplied to the coolant inlet holes 77 through matching coolant transfer holes 81 in the interior surface 64 of the lower section 58. The coolant circulates through the interior chamber, absorbing heat, and is then passed out through the coolant outlet 79. It may then be cooled, for example using a conventional radiator (not shown), and recirculated for reuse.

The lower section 58 and upper section 60 receive a plurality of intake valve assemblies 39 and a plurality of exhaust valve assemblies 47. It should be appreciated that for a single cylinder engine, a single intake valve assembly 39 and a single exhaust valve assembly 47 would be used. The valve assemblies 39 and 47 are generally similar in construction to each other, with the intake valve assembly 39 being slightly larger in scale. The construction of the intake valve assembly 39 will be described in detail, with the understanding that the details are applicable to both of the valve assemblies 39, 47.

Figure 7:
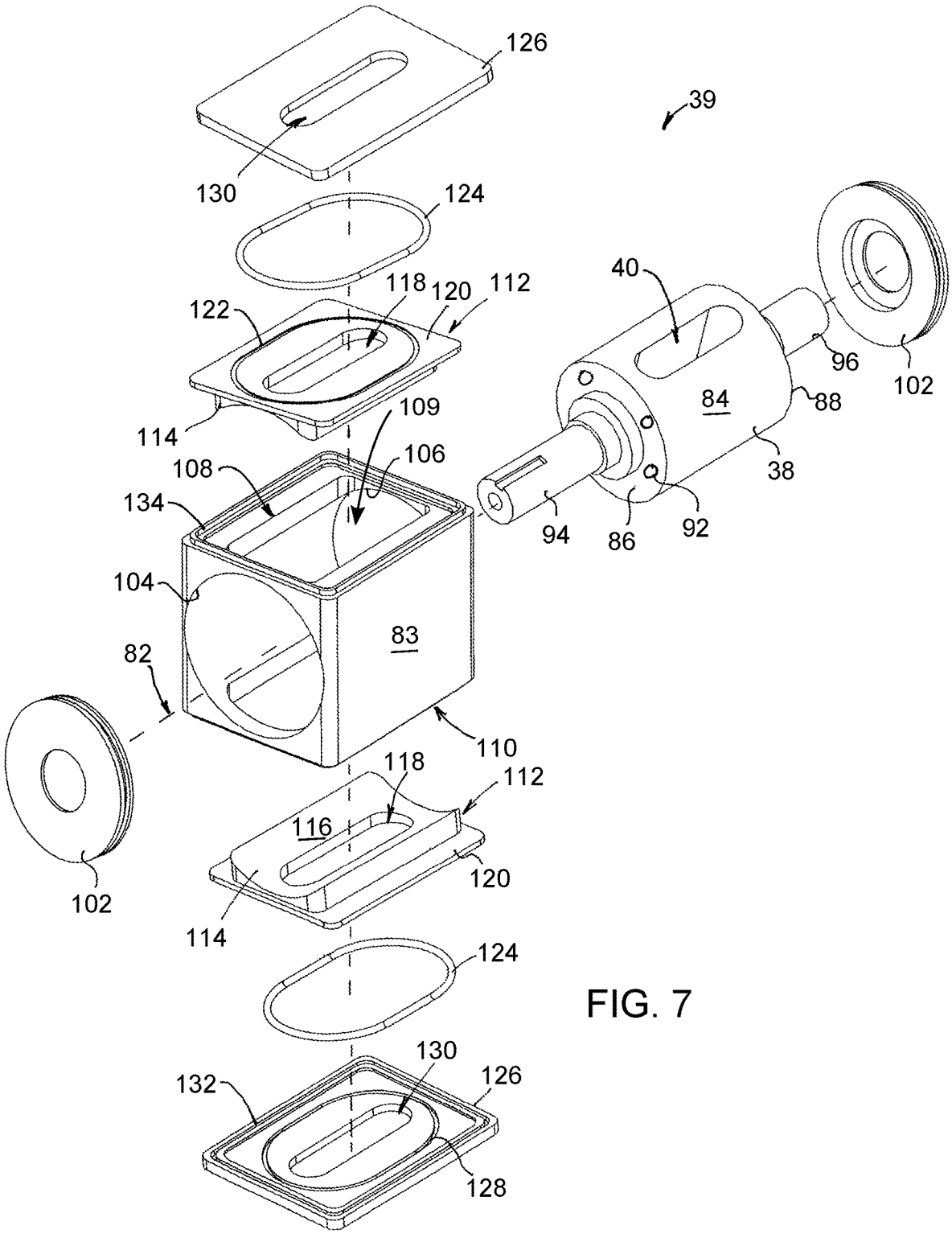
FIG. 7 is an exploded view of a rotating valve assembly.

Referring to FIG. 7, the intake valve assembly 39 includes a housing 83 for receiving the intake valve barrel 38 therein. Each intake valve barrel 38 is a generally cylindrical element with an annular peripheral surface 84 extending between forward and aft end faces 86, 88. An intake aperture 40 extends transversely through the intake valve barrel 38, communicating with the peripheral surface 84 on opposite sides. The cross-sectional flow area of the aperture 40 is constant over its length. In the illustrated example, the intake aperture 40 has a "racetrack" cross-sectional shape, with two parallel sides connected by two semicircular ends. Other cross-sectional shapes may be used. An intake valve shaft 80A is formed by coupling a plurality of intake valve assemblies 39 together using coupling 41. Likewise an exhaust valve shaft 80B is formed by coupling a plurality of exhaust valve assemblies 47 together using coupling 43. The couplings 41, 43 are designed to permit each valve assembly 39 or 47 to be removed from the respective valve shaft 80A, 80B one at a time for easy replacement.

The lateral dimension of the intake aperture 40 (perpendicular to axis 82), the diameter of the intake valve barrel 38, and the rotational speed of the intake valve shaft 80A relative to the crankshaft speed all effect the valve open time or "duration", and these effects are inter-related. This is also true for the exhaust valve barrels 46. These variables may be manipulated in order to adapt the intake valve shaft 80A and/or exhaust valve shaft 80B to suit a particular application. For example, the intake valve barrels 38 could be a different diameter than the exhaust valve barrels 46. In one non-limiting example, the ratio of the diameter of the intake valve barrels 38 to the diameter of the exhaust valve barrels 46 could be about 1:1 to about 4:1.

The intake valve barrel 38 may be made from a rigid, wear-resistant material such as a metal alloy or ceramic. A wear coating such as ceramic or carbide may be applied to all or part of the intake valve barrel 38, particularly the peripheral surface 84, to improve its wear properties.

Optionally, longitudinal holes 92 or other openings may be formed in the intake valve barrel 38 extending between the forward and aft end faces 86, 88. These holes 92 may be used to reduce the mass of the intake valve barrel 38, for balancing purposes, and/or to provide a cooling air flow.

A cylindrical forward stub shaft 94 extends from the forward end face 86, and a cylindrical aft stub shaft 96 extends from the aft end face 88.

The stub shafts 94, 96 may include mating mechanical alignment features to transfer torque between two adjacent intake valve barrels 38 and to maintain a specific angular relationship therebetween. It will be understood that the intake aperture 40 of each intake valve barrel 38 must have a specific angular orientation which is dependent on the cylinder firing sequence of the engine 10. The mechanical alignment feature described above may be configured so that any intake valve barrel 38 may be used in any location within the intake valve shaft 80A, that is, the mechanical alignment feature may accommodate multiple angular alignments, or alternatively the mechanical alignment feature may be configured to produce only a single angular alignment, in which case each intake valve barrel 38 would need to be placed in a specific location within the intake valve shaft 80A.

Seals 102 are positioned on each stub shaft 94, 96 and pressed into apertures 104, 106 of the housing 83 to provide sealing along ends of the valve barrel 38. The housing 83 also includes an open top 108 and an open bottom 110 to receive valve seal assemblies 112. As shown, the housing 83 includes an internal cavity 109 in fluid communication with the open top 108 and open bottom 110 as well as apertures 104 and 106. As shown, the housing 83 is of a rectangular configuration to match a size and shape of valve assembly recesses 66 and 72 of the cylinder head 57 and provide a tight fit therein; however, it should be appreciated that the housing 83 and valve assembly recesses 66 and 72 may have other suitable matching configurations. As illustrated, the valve seal assemblies 112 are used in both the open top 108 and open bottom 110; thus, only a single assembly will be discussed.

The seal assembly 112 includes a seal 114 having a concave valve barrel mating surface 116, an aperture 118 having a size (within 10%) and shape substantially equal to the intake aperture 40 to permit flow therethrough, and a backer plate 120. The seal 114 may be made of any suitable material capable of providing a seal and wear resistance such as a graphite material. The backer plate 120 includes a ring seal slot 122 for receiving ring seal 124 therein. Ring seal 124 provides additional sealing to prevent gases from escaping between the backer plate 120 and cover 126. Ring seal 124 may have suitable cross-sectional shape to allow the ring seal 124 to contract and expand during operation, thereby allowing the seal 114 to float along the barrel 38 as it expands during operation from heat. For example, the ring seal 124 may have a c-shaped cross section.

Cover 126 includes a corresponding ring seal slot 128 for receiving the ring seal 124 therein and compressing the seal 124 between the backer plate 120 and the cover 126 when assembled. Cover 126 also includes an aperture 130 extending therethrough to allow gases to flow through the barrel 38, the seal 114 and the cover 126 from the intake port 34 into combustion chamber 30 (i.e. in fluid communication). The cover 126 further includes a housing slot 132 for receiving housing projection 134 (continuous projections around a periphery of the open top 108 and open bottom 110) therein, thereby securing the cover 126 to the housing 83 and maintaining the seal assembly 112 in the open top 108 or open bottom 110.

Figure 8:
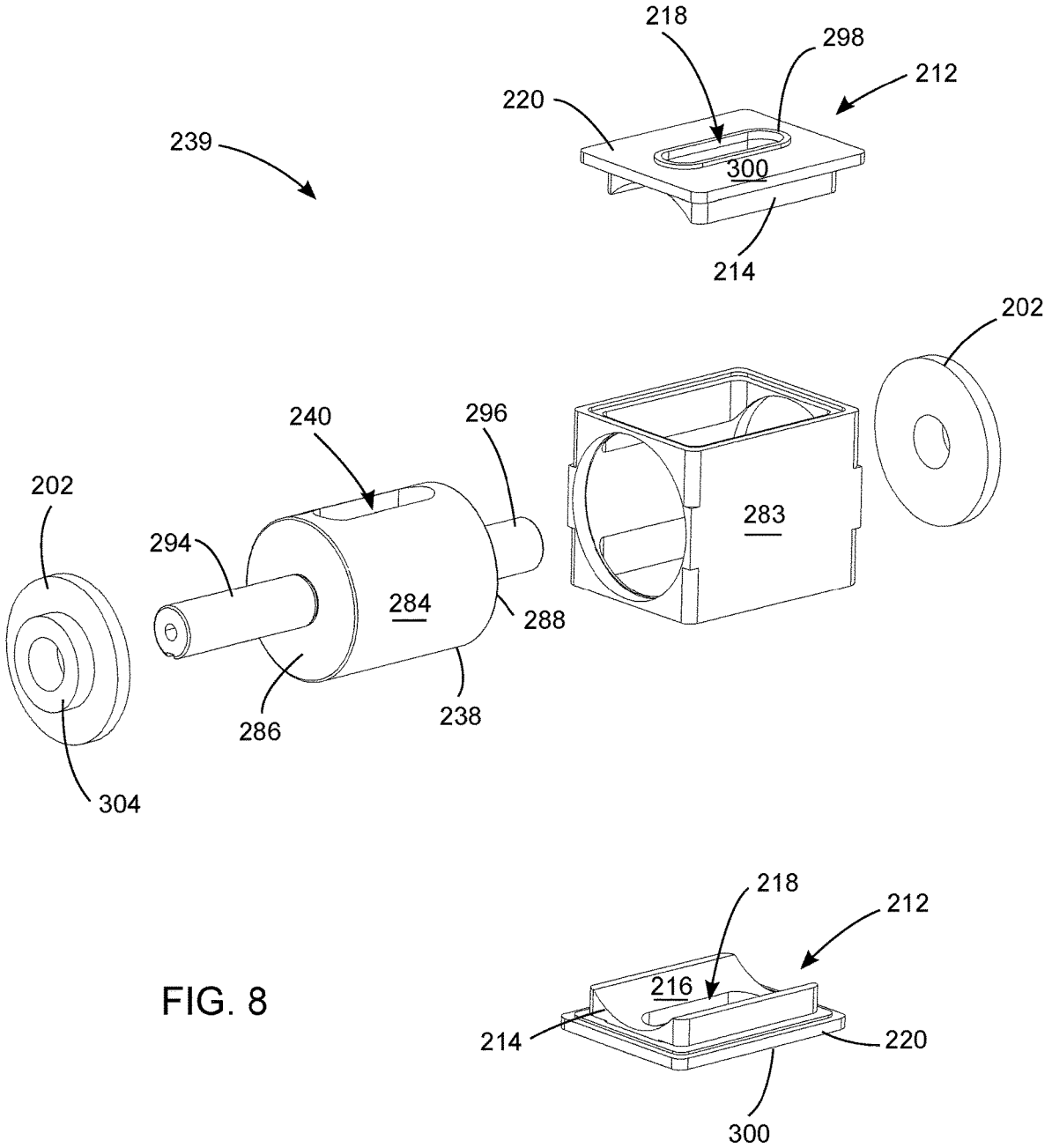
FIG. 8 is an exploded view of a rotating valve assembly.
Figure 9:
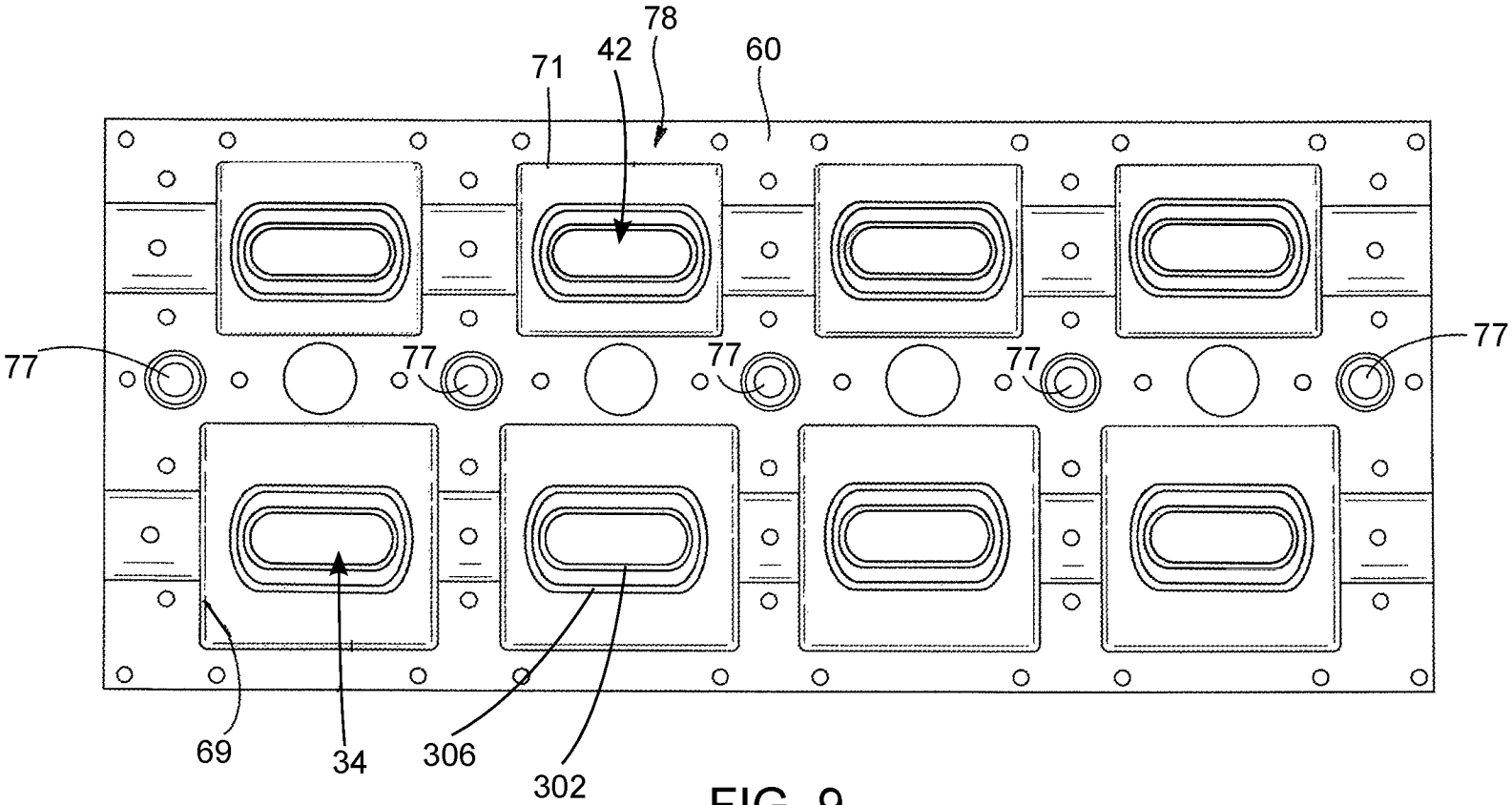
FIG. 9 is a bottom plan view of an upper section of the cylinder head assembly.
Figure 13:
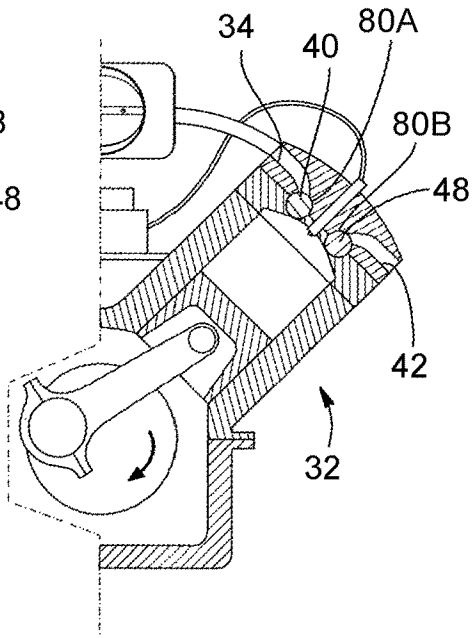
FIG. 13 is a schematic view of a portion of the engine in operation, during an exhaust stroke.
Figure 12:
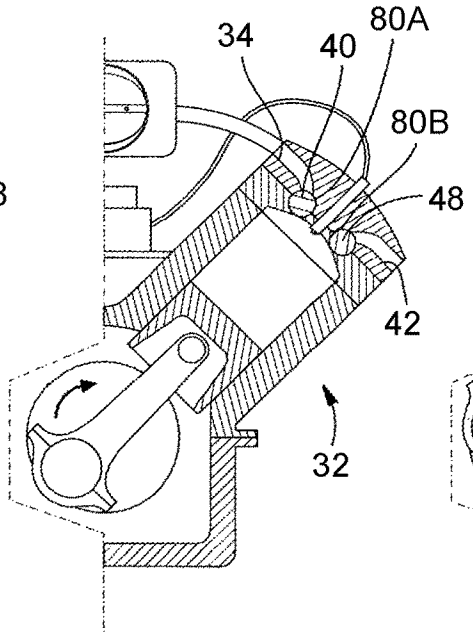
FIG. 12 is a schematic view of a portion of the engine in operation, during a power stroke.
Figure 11:
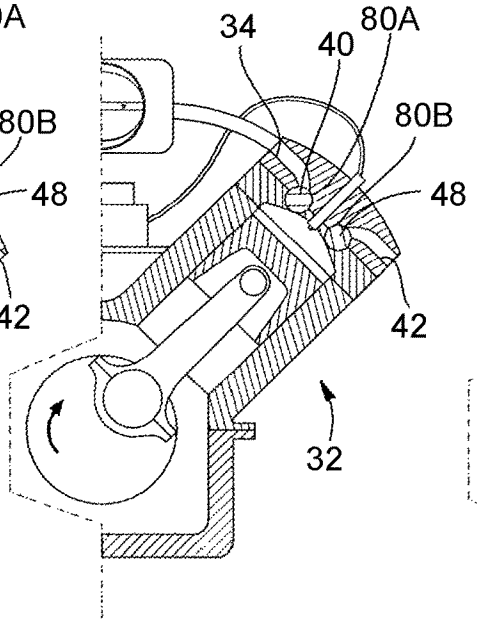
FIG. 11 is a schematic view of a portion of the engine in operation, during a compression stroke.
Figure 10:
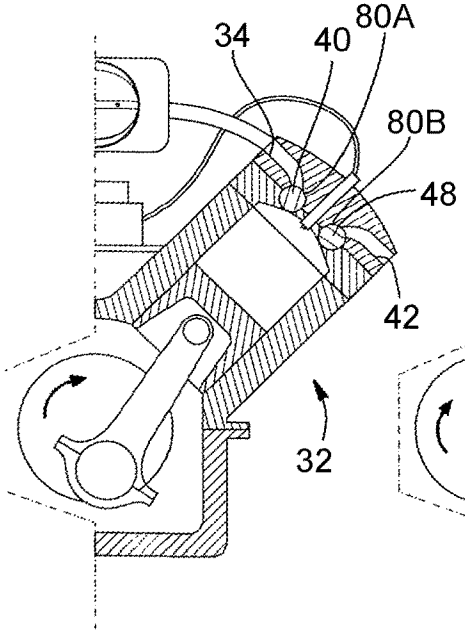
FIG. 10 is a schematic view of a portion of the engine in operation, during an intake stroke.

Referring to FIGS. 8 and 9, intake valve assembly 239 is shown. The following description would also apply to an exhaust valve assembly. Like intake valve assembly 39, intake valve assembly 239 includes a housing 283; an intake valve barrel 238 having a peripheral surface 284 extending between forward and aft end faces 286, 288, an intake aperture 240 extending transversely through the intake barrel 238, and forward and aft stub shafts 294, 296; seals 202 positioned on each stub shaft 294, 296; and a seal assembly 212 with seal 214 having mating surface 216, aperture 218, and a backer plate 220. Unlike intake valve assembly 39, intake valve assembly 239 does not include covers 126.

As shown, seals 202 incorporate a bearing surface 304; however, it should be appreciated that other types of bearings may be used to allow the valve barrel 238 to rotate relative to the cylinder head 57. For example, other suitable bearings may be roller bearings.

The backer plate 220 includes a raised ridge 298 extending from a rear surface 300 of the backer plate 220. The ridge 298 is adapted for mating engagement with recesses 302 formed in the upper 60 and lower 58 sections of the cylinder head 57. For clarity, only the upper section 60 is shown. The mating engagement between the ridge 298 and recesses 302 provides a labyrinth-type arrangement which disperses pressure from the cylinder during combustion, thereby reducing the amount of pressure seen by ring seal 124. Further, as pressurized gas migrates through the labyrinth-type arrangement created by the recesses 302 and ridge 298, a small amount of residual gas is trapped and presses against the ridge 298. This causes the seal 214 to be pressed against the valve barrel 238, thereby increasing sealing between the seal 214 and peripheral surface 284 of the valve barrel 238.

As illustrated, recesses 306 are also formed in the upper 60 and lower 58 sections of the cylinder head 57. Recess 306 surrounds recess 302 and is adapted to receive ring seal 124 therein. Thus, unlike valve assembly 39, ring seal 124 is not sandwiched between the backer plate 220 and a cover; rather, when installed, ring seal 124 is compressed between the rear surface 300 of the backer plate 220 and the recess 306 of the cylinder head 57 and is positioned around the raised ridge 298.

For clarity, only valve assemblies 39 and 47 are discussed below; however, it should be appreciated that the general description also applies to valve assembly 239. In use, valve assemblies 39 and 47 are assembled and pre-packaged for use. When one of the valve assemblies 39, 47 fail, a user simply decouples the failed valve assembly 39, 47 from the respective valve shaft 80A, 80B and replaces the failed valve assembly 39, 47 with a new valve assembly 39, 47 which simply drops into a respective valve assembly recess 66, 72 and couples the valve assembly 39, 47 to the shaft 80A, 80B.

In the assembled engine, a drive assembly 140 (FIG. 2) is provided for each valve shaft 80A, 80B. The drive assembly 140 may be adjustable. More specifically, the relative angular position may be variable. As shown in FIG. 2, one drive assembly 140 may be provided for each valve shaft 80. A first drive belt 144 connects the two drive assemblies 140 of one cylinder bank 16 with an idler pulley 146, and a second drive belt 148 connects the idler pulley 146 to a crank pulley 150 of the engine 10. The crank pulley 150, idler pulleys 146, and drive assemblies 140 are sized such that each valve shaft 80 rotates at one-quarter of the rotational speed of the crankshaft 18, or in other words the drive arrangement provides a 4:1 speed reduction. In the illustrated example, the second drive belt 148 connects the idler pulley 146 to the crankshaft at a 2:1 drive ratio (i.e. the idler pulley 146 runs at half crankshaft speed), and the first drive belt 144 connects the drive assemblies 140 to the idler pulley 146 at a 2:1 drive ratio (i.e. the drive assemblies run at half the idler pulley speed). Optionally, one or more of the drive assemblies 140 may incorporate an active adjustment mechanism (not shown) of a known type, for example under control by an electronic control unit (not shown). This type of device is commonly referred to as a "cam phaser". This device may be used to actively control the angular orientation or phase of one or both of the valve shafts 80A, 80B relative to the crankshaft 18. This capability is useful for actively controlling operating characteristics of the engine 10 during operation. In a Diesel cycle engine, this capability could be used to serve the function of a compression brake, by selectively advancing the intake valve shaft 80A when braking is desired.

The operation of the engine 10 will be described with reference to FIGS. 10 through 13, which schematically depict a single cylinder 32 of the engine 10. As noted above, the intake valve shaft 80A and exhaust valve shaft 80B are driven by belts or other suitable drive apparatus and rotate at one-quarter of the rotational speed of the crankshaft 18. During the four strokes of the engine 10 using a conventional Otto cycle, the intake valve shaft 80A and exhaust shaft 80B continuously rotate to position their respective apertures 40, 48 in the proper position relative to the ports 34, 42. As shown, during the intake stroke (FIG. 10), the intake aperture 40 of the intake valve shaft 80A is substantially aligned with the intake port 34 to allow air into the combustion chamber 30. The exhaust aperture 48 of the exhaust valve shaft 80B is positioned such that exhaust valve shaft 80B closes the exhaust port 42 and air or gas is prevented from escaping the combustion chamber 30 through the exhaust port 42. During the compression stroke, FIG. 11, the apertures 40 and 48 of the intake and exhaust valve shafts 80A and 80B are both rotated to close off the intake port 34 and exhaust port 42. During the power stroke, FIG. 12, the apertures 40 and 48 of the intake and exhaust shafts 80A and 80B continue to keep the intake and exhaust ports 34, 42 closed. Finally, during the exhaust stroke, FIG. 13, the intake valve shaft 80A continues to close the intake port 34 and the exhaust valve shaft 80B is positioned such that the exhaust port 42 is now opened by substantially aligning the exhaust aperture 48 with the exhaust port 42. The cycle then continues. During this process, there may be overlap of the openings of the valve shafts 80A and 80B similar to valve overlap in a conventional poppet-valve engines. For example, the intake port 34 may start opening as the exhaust port 42 begins to close, such that the intake port 34 and exhaust port 42 are both open for some period of time. This overlap can be beneficial in accelerating filling of the cylinder 32 with the intake mixture. As noted above, the angular separation of the apertures 40 and 48 may be adjusted to change the timing of valve events and the degree of overlap.

The apparatus described above has several advantages over the prior art. The rotary valve structure has significantly lower parts count and frictional losses as compared to a conventional poppet valve-train. The rotary valve structure also has the potential to be much more reliable than a conventional valve-train because it does not require reciprocating movement and does not rely on highly-stressed valve springs for operation at high engine speeds.

Furthermore, the sealing assembly described herein will provide effective sealing of the rotating valve assembly while permitting low mechanical loads and long component life.

It will be understood that the present invention may be implemented as a complete engine, or that the cylinder head assemblies described herein may be retrofitted to an existing internal combustion engine, or that the rotating valve assembly may be incorporated into a cylinder head design.

The foregoing has described an engine with rotating valve assembly. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A removable valve assembly positioned between upper and lower portions of a cylinder head assembly, the removable valve assembly comprising:

a housing having an internal cavity, an open top, and an open bottom, the open top and open bottom being in fluid communication with the internal cavity;

a valve barrel positioned in the internal cavity and adapted for rotation therein, the valve barrel having an annular peripheral surface and an aperture extending transversely therethrough communicating with the peripheral surface on opposite sides;

a first seal assembly positioned in the open top and a second seal assembly positioned in the open bottom, wherein the first and second seal assemblies each include a seal having a sealing surface in mating engagement with the peripheral surface and an aperture extending therethrough, the aperture having a size and shape substantially equal to the aperture in the valve barrel to permit flow therethrough; and wherein when the aperture of the valve barrel is in alignment with the apertures of the first and second seal assemblies, gas is permitted to flow between the upper and lower portions through the removable valve assembly.

2. The removable valve assembly according to claim 1, wherein the valve barrel further includes a first stub shaft extending from a forward end face of the valve barrel and a second stub shaft extending from an aft end face of the valve barrel.

3. The removable valve assembly according to claim 2, wherein the first and second stub shafts include mating mechanical alignment features to transfer torque between two adjacent valve barrels and maintain a specific angular relationship therebetween.

4. The removable valve assembly according to claim 1, wherein the housing further includes first and second spaced-apart and axially aligned apertures, the first and second apertures are configured to permit the valve barrel to slide therethrough and into the internal cavity for rotation therein.

5. The removable valve assembly according to claim 4, further including a first seal positioned in the first aperture and a second seal positioned in the second aperture to provide sealing of the apertures.

6. The removable valve assembly according to claim 1, wherein each of the first and second seal assemblies further include a backer plate connected to the seal.

7. The removable valve assembly according to claim 6, further including first and second ring seals, wherein the first ring seal is positioned between the first seal assembly backer plate and a first cover of the valve assembly and the second ring seal is positioned between the second seal assembly backer plate and a second cover of the valve assembly.

8. The removable valve assembly according to claim 6, further including first and second ring seals, wherein the first ring seal is positioned around a first raised ridge of the first seal assembly backer plate and the second ring seal is positioned around a second raised ridge of the second seal assembly backer plate.

9. The removable valve assembly according to claim 8, wherein the first ring seal is positioned between the first seal assembly backer plate and a lower section of a cylinder head and the second ring seal is positioned between the second seal assembly backer plate and an upper section of the cylinder head.

10. The removable valve assembly according to claim 7, wherein the first seal assembly backer plate and first cover each include a recess for receiving the first ring seal and the second seal assembly backer plate and second cover each include a recess for receiving the second ring seal.

11. The removable valve assembly according to claim 9, wherein the lower section and upper section each include an inner recess for receiving the first and second raised ridges therein and an outer recess for receiving the first and second ring seals therein.

12. A cylinder head assembly, comprising:

a cylinder head having upper and lower cylinder head sections;

at least one intake valve assembly pocket defined by the upper and lower cylinder head sections and at least one exhaust intake valve assembly pocket defined by the upper and lower cylinder head sections;

at least one removable intake valve assembly positioned in the at least one intake valve assembly pocket and at least one removable exhaust valve assembly positioned in the at least one exhaust valve assembly pocket, the at least one removable intake valve assembly and at least one removable exhaust valve assembly each comprises:

a housing having an internal cavity, an open top, and an open bottom, the open top and open bottom being in fluid communication with the internal cavity;

a valve barrel positioned in the internal cavity and adapted for rotation therein, the valve barrel having an annular peripheral surface and an aperture extending transversely therethrough communicating with the peripheral surface on opposite sides;

a first seal assembly positioned in the open top and a second seal assembly positioned in the open bottom, wherein the first and second seal assemblies each include a seal having a sealing surface in mating engagement with the peripheral surface and an aperture extending therethrough, the aperture having a size and shape substantially equal to the aperture in the valve barrel to permit flow therethrough; and wherein when the aperture of the valve barrel is in alignment with the apertures of the first and second seal assemblies, gas is permitted to flow between the upper and lower cylinder head sections through the removable valve assembly.

13. The cylinder head assembly according to claim 12, wherein the cylinder head assembly further includes a combustion chamber having an intake opening and an exhaust opening, an intake port, and an exhaust port, the at least one removable intake valve assembly being positioned between the intake opening and the intake port and the at least one removable exhaust valve assembly being positioned between the exhaust opening and the exhaust port.

14. The cylinder head assembly according to claim 12, wherein each of the at least one removable intake valve assembly and at least one removable exhaust valve assembly further include a first backer plate connected to the first seal and a second backer plate connected to the second seal.

15. The cylinder head assembly according to claim 14, wherein each of the at least one removable intake valve assembly and at least one removable exhaust valve assembly further including first and second ring seals, wherein the first ring seal is positioned between the first seal assembly backer plate and a first cover of the valve assembly and the second ring seal is positioned between the second seal assembly backer plate and a second cover of the valve assembly.

16. The cylinder head assembly according to claim 12, wherein each of the at least one removable intake valve assembly and at least one removable exhaust valve assembly further include first and second ring seals, wherein the first ring seal is positioned around a first raised ridge of the first seal assembly backer plate and the second ring seal is positioned around a second raised ridge of the second seal assembly backer plate.

17. The cylinder head assembly according to claim 16, wherein the first ring seal is positioned between the first seal assembly backer plate and the lower cylinder head section and the second ring seal is positioned between the second seal assembly backer plate and the upper cylinder head section.

18. The cylinder head assembly according to claim 15, wherein the first seal assembly backer plate and first cover each include a recess for receiving the first ring seal and the second seal assembly backer plate and second cover each include a recess for receiving the second ring seal.

19. The cylinder head assembly according to claim 17, wherein the lower cylinder head section and upper cylinder head section each include an inner recess for receiving the first and second raised ridges therein and an outer recess for receiving the first and second ring seals therein.

20. A removable valve assembly, comprising:

a housing having an internal cavity, an open top, and an open bottom, the open top and open bottom being in fluid communication with the internal cavity;

a valve barrel positioned in the internal cavity and adapted for rotation therein, the valve barrel having an annular peripheral surface and an aperture extending transversely therethrough communicating with the peripheral surface on opposite sides;

a first seal assembly positioned in the open top and a second seal assembly positioned in the open bottom, wherein the first and second seal assemblies each include a seal having a sealing surface in mating engagement with the peripheral surface and an aperture extending therethrough, the aperture having a size and shape substantially equal to the aperture in the valve barrel to permit flow therethrough, wherein each of the first and second seal assemblies further include a backer plate connected to the seal;

first and second ring seals, wherein the first ring seal is positioned between the first seal assembly backer plate and a first cover of the valve assembly and the second ring seal is positioned between the second seal assembly backer plate and a second cover of the valve assembly; and wherein when the aperture of the valve barrel is in alignment with the apertures of the first and second seal assemblies, gas is permitted to flow through the removable valve assembly.

* * * * *